US011336975B1

(12) United States Patent
Zachara et al.

(10) Patent No.: US 11,336,975 B1
(45) Date of Patent: May 17, 2022

(54) WEARABLE DEVICE WITH DETUNE-RESILIENT ANTENNA

(71) Applicant: Shure Acquisition Holdings, Inc., Niles, IL (US)

(72) Inventors: Christopher Zachara, Williamsburg, VA (US); Mark Coster, Wilmette, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 17/163,860

(22) Filed: Feb. 1, 2021

(51) Int. Cl.

| | |
|---|---|
| ***H04R 1/02*** | (2006.01) |
| ***H01Q 1/27*** | (2006.01) |
| ***H04R 1/10*** | (2006.01) |
| ***H01Q 9/04*** | (2006.01) |

(52) U.S. Cl.
CPC ..... *H04R 1/02* (2013.01); *H01Q 1/273* (2013.01); *H01Q 9/0407* (2013.01); *H04R 1/1041* (2013.01); *H04R 1/1075* (2013.01)

(58) Field of Classification Search
CPC ..... H04R 1/02; H04R 1/1041; H04R 1/1075; H01Q 9/0407; H01Q 1/273
See application file for complete search history.

(56) References Cited

U.S. PATENT DOCUMENTS

| | | | |
|---|---|---|---|
| 4,419,995 | A | 12/1983 | Hochmair et al. |
| 6,552,686 | B2 | 4/2003 | Ollikainen et al. |
| 6,762,724 | B2 | 7/2004 | Peng |
| 7,342,539 | B2 | 3/2008 | Rosenberg et al. |
| 7,652,628 | B2 | 1/2010 | Zweers |
| 7,679,566 | B2 | 3/2010 | Higasa et al. |
| 7,916,089 | B2 | 3/2011 | Schlub et al. |
| 8,340,309 | B2 | 12/2012 | Burnett et al. |
| 8,428,285 | B2 | 4/2013 | Khamashta et al. |
| 8,432,322 | B2 | 4/2013 | Amm et al. |
| 8,803,760 | B2 | 8/2014 | Chakam et al. |
| 8,855,353 | B2 | 10/2014 | Meesters |
| 8,866,681 | B2 | 10/2014 | Rozan |
| 8,878,735 | B2 | 11/2014 | Kvist et al. |

(Continued)

FOREIGN PATENT DOCUMENTS

| | | | |
|---|---|---|---|
| CN | 206040954 | U | 3/2017 |
| CN | 206370492 | U | 8/2017 |

(Continued)

OTHER PUBLICATIONS

Chou, Jui-Hung and Su, Saou-Wen, "Matching a Bluetooth Headset Antenna on a Small System Ground by Using a Conductive Wire," Optical Technology Letters, 10.1002/mop.24755, DeepDyve, 5 pages (Mar. 6, 2009), printed Mar. 27, 2020.

*Primary Examiner* — Simon King
(74) *Attorney, Agent, or Firm* — Banner & Witcott, Ltd.

(57) ABSTRACT

A wearable device, such as an earphone, may include a conformal antenna that is resilient to performance degradation due to user-interactions and manufacturing process variances. The antenna may comprise one or more surfaces suitable for receiving and transmitting electromagnetic signals, wherein the one or more surfaces of the antenna may be non-parallel with a ground plane and a user-interactable surface, thereby minimizing image current cancellation and coupling between the antenna and a user finger during user interactions with the user-interactable surface.

20 Claims, 5 Drawing Sheets

(56) References Cited

U.S. PATENT DOCUMENTS

| | | | | |
|---|---|---|---|---|
| 8,976,957 | B2 | 3/2015 | Pavlov et al. | |
| 9,293,828 | B2 | 3/2016 | Bevelacqua et al. | |
| 9,319,808 | B2 | 4/2016 | Ruaro | |
| 9,357,283 | B2 | 5/2016 | Darlington | |
| 9,661,427 | B2 | 5/2017 | Bauman et al. | |
| 9,680,209 | B2 | 6/2017 | Troelsen et al. | |
| 9,748,654 | B2 | 8/2017 | Teoh | |
| 9,838,771 | B1 | 12/2017 | Masaki et al. | |
| 9,949,014 | B2 | 4/2018 | Cramer et al. | |
| 10,129,635 | B1 | 11/2018 | Zhu et al. | |
| 10,154,334 | B1 | 12/2018 | Lin et al. | |
| 10,206,026 | B2 | 2/2019 | Yeung et al. | |
| 10,219,084 | B2 | 2/2019 | Meskens et al. | |
| 10,244,303 | B2 | 3/2019 | Xu et al. | |
| 10,334,373 | B2 | 6/2019 | Troelsen et al. | |
| 10,516,206 | B2 * | 12/2019 | Riisberg | H01Q 9/0464 |
| 10,595,138 | B2 | 3/2020 | Pinto | |
| 11,109,135 | B1 * | 8/2021 | Corona Aparicio | H04R 5/0335 |
| 11,184,696 | B1 * | 11/2021 | Li | H01Q 1/24 |
| 11,190,878 | B1 * | 11/2021 | Patel | G01N 21/3563 |
| 2008/0001191 | A1 | 5/2008 | Kim et al. | |
| 2008/0119138 | A1 | 5/2008 | Kim et al. | |
| 2008/0143610 | A1 * | 6/2008 | Wang | H01Q 1/22 343/702 |
| 2009/0174612 | A1 * | 7/2009 | Ayala | H01Q 1/2266 343/702 |
| 2010/0136912 | A1 * | 6/2010 | Mohammadian | H01Q 1/242 343/702 |
| 2011/0050509 | A1 * | 3/2011 | Ayala Vazquez | H01Q 1/42 343/702 |
| 2011/0001220 | A1 | 5/2011 | Kim | |
| 2011/0122034 | A1 | 5/2011 | Kim | |
| 2013/0005003 | A1 | 2/2013 | Takemura et al. | |
| 2013/0050037 | A1 | 2/2013 | Takemura et al. | |
| 2017/0000648 | A1 | 3/2017 | Jiang et al. | |
| 2017/0064830 | A1 | 3/2017 | Jiang et al. | |
| 2017/0001881 | A1 | 6/2017 | Rabel et al. | |
| 2017/0188163 | A1 | 6/2017 | Rabel et al. | |
| 2018/0254546 | A1 * | 9/2018 | Shamsoddini | H04B 1/385 |
| 2019/0001036 | A1 | 4/2019 | Cousins et al. | |
| 2019/0103661 | A1 | 4/2019 | Cousins et al. | |
| 2019/0032755 | A1 | 10/2019 | Linden et al. | |
| 2019/0327550 | A1 | 10/2019 | Linden et al. | |
| 2020/0000150 | A1 | 1/2020 | Abadia et al. | |
| 2020/0002824 | A1 | 1/2020 | Kim | |
| 2020/0015023 | A1 | 1/2020 | Abadia et al. | |
| 2020/0028246 | A1 | 1/2020 | Kim | |
| 2020/0009159 | A1 | 3/2020 | Su et al. | |
| 2020/0091590 | A1 | 3/2020 | Su et al. | |
| 2020/0010711 | A1 | 4/2020 | Ji et al. | |
| 2020/0107110 | A1 | 4/2020 | Ji et al. | |
| 2020/0244104 | A1 * | 7/2020 | Katajamaki | H01Q 1/2291 |
| 2020/0335855 | A1 * | 10/2020 | Chen | H01Q 11/08 |
| 2020/0335856 | A1 | 10/2020 | Kim et al. | |

FOREIGN PATENT DOCUMENTS

| | | | |
|---|---|---|---|
| CN | 206379458 | U | 8/2017 |
| CN | 206471479 | U | 9/2017 |
| CN | 206894849 | U | 1/2018 |
| CN | 206993370 | U | 2/2018 |
| CN | 207082628 | U | 3/2018 |
| CN | 207559042 | U | 6/2018 |
| CN | 104333826 | B | 2/2019 |
| CN | 110323542 | A | 10/2019 |
| CN | 209487701 | U | 10/2019 |
| CN | 209627637 | U | 11/2019 |
| CN | 209880797 | U | 12/2019 |
| CN | 210016598 | U | 2/2020 |
| EP | 2182579 | A1 | 5/2010 |
| JP | 09214223 | A | 8/1997 |
| JP | 2017147566 | A | 8/2017 |
| KR | 20070040950 | A | 4/2007 |
| KR | 20180093373 | A | 8/2018 |
| WO | 2014088224 | A1 | 6/2014 |
| WO | 2015127973 | A1 | 9/2015 |
| WO | 2019035561 | A1 | 2/2019 |
| WO | 2019038178 | A1 | 2/2019 |
| WO | 2019120134 | A1 | 6/2019 |
| WO | 2019130843 | A1 | 7/2019 |
| WO | 2020005818 | A1 | 1/2020 |

* cited by examiner

WEARABLE DEVICE WITH DETUNE-RESILIENT ANTENNA

BACKGROUND

Small wearable devices with integrated antennas may communicate over short distances with other compatible devices. However, several challenges are associated with the design and integration of high-performance antenna structures in these wearable devices. For example, wearable devices, such as wireless earphones, may need to be small enough to partially fit inside an ear canal of a wearer. Antenna structures may be one of the largest components of a wearable device, yet the antenna must conform to a small region of space while efficiently operating in close proximity to other potentially parasitic components of the device.

Furthermore, the proximity of the human body to a small wearable device may degrade antenna radiation efficiency, possibly resulting in reduced device performance and reduced battery life. Wireless earphones may be particularly susceptible to performance degradation due to frequent user-interactions with the surface of the earphones that occur within the near-field range of the antenna, resulting in capacitive coupling and detuning.

Some wearable devices, such as wireless earphones, may integrate antennas with various geometries, however, many of these antenna structures may be vulnerable to performance degradation due to capacitive coupling from a user-interaction with the device surface.

SUMMARY

The following paragraphs present a simplified summary of certain features. The summary is not an extensive overview and is not intended to identify key or critical elements.

According to some aspects, a wearable device, such as a wireless earphone, may have a conformal antenna structure. An area of an orthogonal projection of the antenna onto a plane that is parallel with a ground plane may be less than a physical aperture of the antenna. Moreover, the antenna may comprise a plurality of surfaces wherein each of the surfaces conforms in shape with a semi-circular region of the encasing. For the purposes of this disclosure, a surface of the antenna is defined as a portion of the antenna that receives and collects electromagnetic radiation for use by the wearable device. Furthermore, the ground plane may correspond to an antenna ground plane comprising one or more of a main printed-circuit-board, a battery, and other electrically connected and conductive components. The surface normal, which is a well-known concept in-the-art, describes the orientation of a surface. A surface has an orientation and thus may be parallel or non-parallel to another surface such as the ground plane. According to aspects of this disclosure, one or more surfaces of the antenna may be non-parallel with the ground plane. A surface may be adjacent to one or more other surfaces such that the surface is non-parallel with the adjacent other surfaces. Furthermore, an orthogonal projection of one or more surfaces of the antenna onto a plane that is parallel with a top surface of the wearable device, accessible to user interactions, consists of an area that is less than the total surface area of the antenna.

In some embodiments, one or more surfaces of the antenna may be non-parallel with the user-interactable surface of the earphone, thus minimizing capacitive coupling with portions of a user fingertip during a user interaction. As another example, a first surface of the antenna may extend parallel with the ground plane, a second surface of the cross-section of the antenna may extend away from and non-parallel to the ground plane, and a third surface of the cross-section of the antenna may extend towards and non-parallel to the ground plane, such that the antenna structure conforms to the shape of an earphone housing. As in the previous example, the user-interactable surface may comprise a surface that is non-parallel with some or all surfaces of the conformal antenna structure. A cross-section of the conformal antenna may comprise a shape similar to the letter "z" or the letter "s." The conformal antenna structure may be tapered at one end in order to provide some isolation from the ground plane, thus minimizing the detrimental radiation effects of the image current while increasing the operating frequency range. The tapered end may be a linear tapering corresponding to a slanted angle. Alternatively, the tapered end may be a non-linear tapering. The conformal antenna structure may be connected to a feedline via a pogo pin and an impedance matching network. Alternatively, the conformal antenna may be connected to a feedline via a pin that is insert-molded into a socket.

According to other aspects, additional components such as flexible printed-circuit-board (PCB) components, surface-mount-device (SMD) components, and traces may be located within the near-field region of the antenna and may act as parasitic elements to the conformal antenna. A decoupling network connecting the traces to the ground plane may comprise at least one of an inductor or a ferrite bead. Furthermore, the inductor or ferrite bead may be selected such that the decoupling network has a maximum impedance at the resonance frequency of the antenna. In this case, a microphone may be located within the semi-circular region without detuning the conformal antenna. Alternatively, an inductance of the decoupling network may be selected such that the traces exhibit the resonance frequency of the conformal antenna structure. In this manner, the traces may operate as a secondary undriven antenna within said near-field region. These and other features and potential advantages are described in greater detail below.

BRIEF DESCRIPTION OF THE DRAWINGS

Some features are shown by way of example, and not by limitation, in the accompanying drawings. In the drawings, like numerals reference similar elements.

DETAILED DESCRIPTION

Figure 1A:
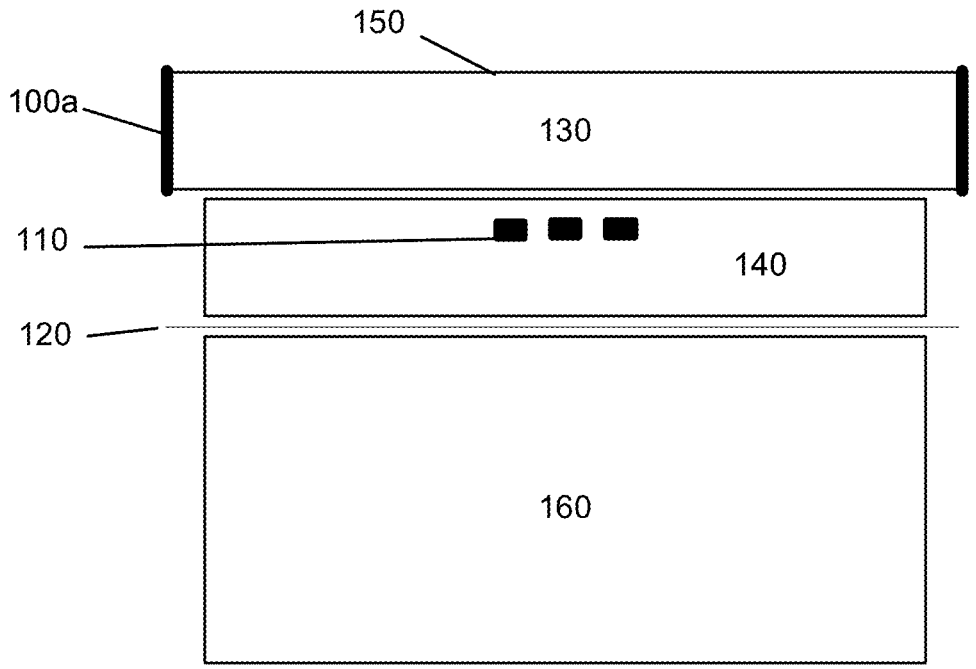
FIGS. 1A-C are diagrams illustrating cross-sections of an antenna structure, according to some embodiments.

The accompanying drawings, which form a part hereof, show examples of the disclosure. It is to be understood that the examples shown in the drawings and/or discussed herein are non-exclusive and that there are other examples of how the disclosure may be practiced.

It is desirable that some wearable devices, such as earphones, be kept small in size, in order to facilitate their intended use. Some currently available earphones may include, among other things, an antenna for Bluetooth communication, micro-electromechanical-system (MEMS) microphones, flexible PCB and SMD components, traces, and an internal battery. These components are fit into a compact housing or encasing of the wearable device, and may be located within the near-field region of the antenna. While it would be desirable to avoid parasitic coupling between the antenna and the other device components, this can be difficult to avoid due to the limited volume of the wearable device or earphones.

Another issue to contend with is the necessary presence of a conducting surface such as a ground plane within the small wearable device. The total radiated field of the conformal antenna is a sum of the contribution from the antenna and its virtual image in the ground plane. The radiated field of an antenna oriented vertically with respect to the ground plane will add constructively with the radiated field from its virtual image, however this scenario is typically difficult to achieve in small wearable devices due to volume constraints. Thus, large portions of the antenna may necessarily be oriented horizontally with respect to the ground plane, which can result in cancellation of some of the radiated field and overall degradation of antenna performance. This problem may be exacerbated by grounded parasitic elements, contained within the wearable device, that effectively function as extensions of the ground plane. Thus, choking off these parasitic elements may aid in maximizing antenna performance.

Furthermore, the antenna performance may be further improved by maximizing the antenna aperture, which is herein defined as the total antenna surface area capable of receiving or transmitting electromagnetic radiation for processing by the earphone. Each antenna surface referred to herein corresponds to a surface area, wherein the sum of the surface areas of all antenna surfaces of the antenna equals the antenna aperture. Although a large antenna aperture is generally desirable, an antenna structure with a large surface area may be vulnerable to capacitive coupling from user-interactions, which may detune the antenna. Such capacitive coupling is avoidable by conforming the antenna structure to portions of side-walls of the wearable device such that capacitive coupling does not occur or is minimized.

Accordingly, aspects of the disclosure are directed to a wearable device, such as an earphone, which employs a conformal antenna structure that is resistant to performance degradation due to parasitic coupling with nearby device components and detuning from user interactions occurring within its near-field region. According to particular embodiments, one or more surfaces of the antenna may be non-parallel with a user-interactable surface, thus minimizing capacitive coupling with portions of a user fingertip during a user interaction. According to some embodiments, a first surface of the antenna may extend parallel with a ground plane, a second surface of the antenna may extend away from and non-parallel to the ground plane, and a third surface of the antenna may extend towards and non-parallel to the ground plane. The antenna may comprise any number of surfaces. Furthermore, the user-interactable surface may comprise a surface that is non-parallel with some or all surfaces of the conformal antenna structure.

FIG. 1A depicts a cross-sectional view of one embodiment of an antenna structure comprising a first conducting element 100*a*, a second conducting element 110, and a ground plane 120 in accordance with aspects described herein. The first conducting element 100*a* may comprise a single conducting element with a surface that is oriented perpendicular with respect to the ground plane 120. A cross-section of the surface of the first conducting element 100*a* is depicted in FIG. 1A. The surface of the first conducting element 100*a* may conform to a semi-circular shape. Moreover, the first conducting element 100*a* may operate as a Bluetooth antenna corresponding to a resonance frequency between 2.400 GHz to 2.482 GHz.

In some embodiments, the surface of the first conducting element 100*a* may comprise a single elongated conducting element that conforms in shape with a semi-circular region of a top region 130 of the earphone. The first conducting element 100*a* may form a semi-circle with a feedline end and tapered end, and may wrap around a portion of a circular region of the top region 130, which may be plastic top region with a surface 150 accessible to user interactions. The diameter of the semi-circle formed by the first conducting element 100*a* may be less than or equal to the size of a wearable device such as an earphone. Thus, the first conducting element 100*a* may be integrated within the earphone device while maintaining an antenna length that enables optimal device performance.

Furthermore, the first conducting element 100*a* may conform to the shape of the top region 130 such that a surface of the first conducting element 100*a* lies perpendicular to both the ground plane 120 and the user-accessible surface 150. In this manner, the antenna aperture of the antenna structure can be made larger while minimizing performance degradation from image currents in the ground plane 120 and capacitive coupling with a user finger at the user-accessible surface 150, thus making efficient use of the available space.

In some embodiments, an orthogonal projection of the first conducting element 100*a* onto a plane that is parallel with the ground plane 120 may correspond to a projected area comprising none or some of the surface area of the first conducting element 100*a*. An orthogonal projection of the first conducting element 100*a* onto a plane that is parallel with the ground plane 120 or onto a plane that is parallel with the user-accessible surface 150 may produce a projected shape with an area that is less than the physical aperture of the first conducting element 100*a*.

The second conducting element 110 may operate as an undriven secondary antenna at the resonance frequency of the first conducting element 100*a*. In some embodiments, the second conducting element 110 may be located within component region 140 and may be further situated between the first conducting element 100*a* and the ground plane 120. The second conducting element 110 may lie on a plane that is parallel with the ground plane 120. Alternatively, the second conducting element 110 may lie on a plane that is not parallel with the ground plane 120. According to other aspects, the second conducting element 110 may be oriented such that it does not lie on a plane.

In some embodiments, an orthogonal projection of the second conducting element 110 onto a plane that is parallel with the ground plane 120 may overlap with an orthogonal projection of the first conducting element 100*a* onto the plane. Alternatively, an orthogonal projection of the second conducting element 110 onto a plane that is parallel with the ground plane 120 may not overlap with an orthogonal projection of the first conducting element 100*a* onto the plane.

In some embodiments, the second conducting element 110 may be located in top region 130. Alternatively, a portion of the second conducting element 110 may be located in the top region 130 and another portion of the second conducting element 110 may be located in the component region 140.

The component region 140 may further contain parasitic elements such as flexible PCB and SMD components. The PCB or SMD components may be located entirely within the component region 140. Alternatively, the PCB or SMD components may be located entirely within the top region 130. According to other aspects, the PCB or SMD components may be located partially in the top region 130 and partially in the component region 140.

In some embodiments, the second conducting element 110 may comprise one or more traces. For example, FIG. 1A depicts a cross-sectional view of the second conducting element 110 as three traces. Moreover, the traces may conform to various shapes such as straight lines, curved lines, or piecewise lines wherein portions of the lines are straight and other portions of the lines are curved. According to other aspects of this disclosure, the ground plane 120 may be located adjacent to region 160. Region 160 may correspond to a power source, such as a battery, for a wireless earphone.

Figure 1B:
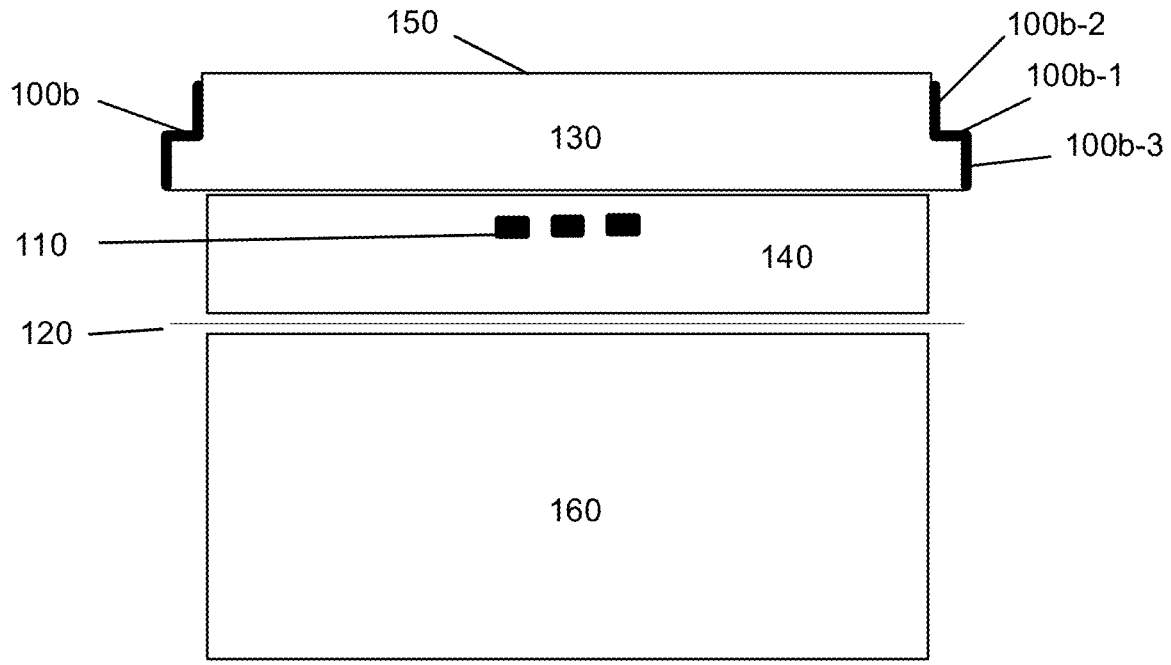

FIG. 1B depicts another embodiment of the antenna structure, wherein the first conducting element 100*b* may comprise three surfaces, wherein each surface may wrap around the top region 130 in order to form a semi-circular shape. Furthermore, a first surface 100*b*-1 of the first conducting element 100*b* may lie on a plane that is parallel with the ground plane 120. A second surface 100*b*-2 of the first conducting element 100*b* may be adjacent to the first surface 100*b*-1 and extend vertically, from the first surface 100*b*-1, towards a user-accessible surface 150. The second surface 100*b*-2 may further extend vertically, from the first surface 100*b*-1, away from both the first surface 100*b*-1 and the ground plane 120. A third surface 100*b*-3 of the first conducting element 100*b* may be adjacent to the first surface 100*b*-1 and extend vertically, from the first surface 100*b*-1, towards the ground plane 120. The third surface 100*b*-3 may further extend vertically, from the first surface 100*b*-1, away from the first surface 100*b*-1 and the user-accessible surface 150.

In some embodiments, a cross-section of the first conducting element 100*b* comprises a "Z" shape with three portions corresponding to surfaces 100*b*-1, 100*b*-2, and 100*b*-3. A portion of the "Z" shape (e.g., 100*b*-1) may be oriented parallel with the ground plane 120 and the other portions of the "Z" shape (e.g., 100*b*-2, 100*b*-3) may be oriented non-parallel with the ground plane 120. Surfaces 100*b*-1, 100*b*-2, and 100*b*-3 may each conform in shape with a semi-circular region of the top region 130.

Although not depicted in FIG. 1B, in some embodiments, the first conducting element 100*b* may comprise surfaces 100*b*-1 and 100*b*-2. A cross-section of the first conducting element 100*b* would then comprise an "L" shape wherein the surface 100*b*-1 may be oriented parallel with the ground plane 120 and the surface 100*b*-2 may be oriented non-parallel with the ground plane 120. Alternatively, the first conducting element 100*b* may comprise only surfaces 100*b*-1 and 100*b*-3. In these embodiments, a cross-section of the first conducting element 100*b* may comprise an "L" shape wherein the surface 100*b*-1 may be oriented parallel with the ground plane 120 and the surface 100*b*-3 may be oriented non-parallel with the ground plane 120. In other embodiments, the first conducting element may comprise other combinations of surfaces such that a cross section of the first conducting element comprises one or more of a "Z" shape, an "S" shape, an "L" shape, or some other shape corresponding to a series of interconnected straight and curved lines.

In some embodiments, an orthogonal projection of the first conducting element 100*b* onto a plane that is parallel with the ground plane 120 may correspond to a projected area comprising some or all of the area of the first surface 100*b*-1 and some or none of the area of the second and third surfaces 100*b*-2 and 100*b*-3. The projected area may be less than the physical aperture of the first conducting element 100*b*. Furthermore, an orthogonal projection of the first surface 100*b*-1 onto a plane that is parallel with the ground plane 120 may produce a projected shape with an area comprising most or all of the area of the first surface 100*b*-1. An orthogonal projection of either the second or third surfaces 100*b*-2 and 100*b*-3 onto a plane that is parallel with the ground plane 120 may produce a projected shape with an area comprising none or some of the area of the second or third surfaces.

In some embodiments, an orthogonal projection of the first conducting element 100*b* onto a plane that is parallel with the user-accessible surface 150 may correspond to a projected area comprising some or all of the area of the first surface 100*b*-1 and some or none of the area of the second and third surfaces 100*b*-2 and 100*b*-3. The projected area may be less than the physical aperture of the first conducting element 100*b*. An orthogonal projection of the first surface 100*b*-1 onto a plane that is parallel with the user-accessible surface 150 may produce a projected shape with an area comprising most or all of the area of the first surface 100*b*-1. An orthogonal projection of either the second or third surfaces 100*b*-2 and 100*b*-3 onto a plane that is parallel with the user-accessible surface 150 may produce a projected shape with an area comprising none or only a partial area of the second or third surfaces.

The second conducting element 110 may operate as an undriven secondary antenna at the resonance frequency of the first conducting element 100*b*. In some embodiments, the second conducting element 110 may be located within component region 140 and may be further situated between the first conducting element 100*b* and the ground plane 120.

In some embodiments, an orthogonal projection of the second conducting element 110 onto a plane that is parallel with the ground plane 120 may overlap with an orthogonal projection of the first conducting element 100*b* onto the plane. Alternatively, an orthogonal projection of the second conducting element 110 onto a plane that is parallel with the ground plane 120 may not overlap with an orthogonal projection of the first conducting element 100*b* onto the plane.

Figure 1C:
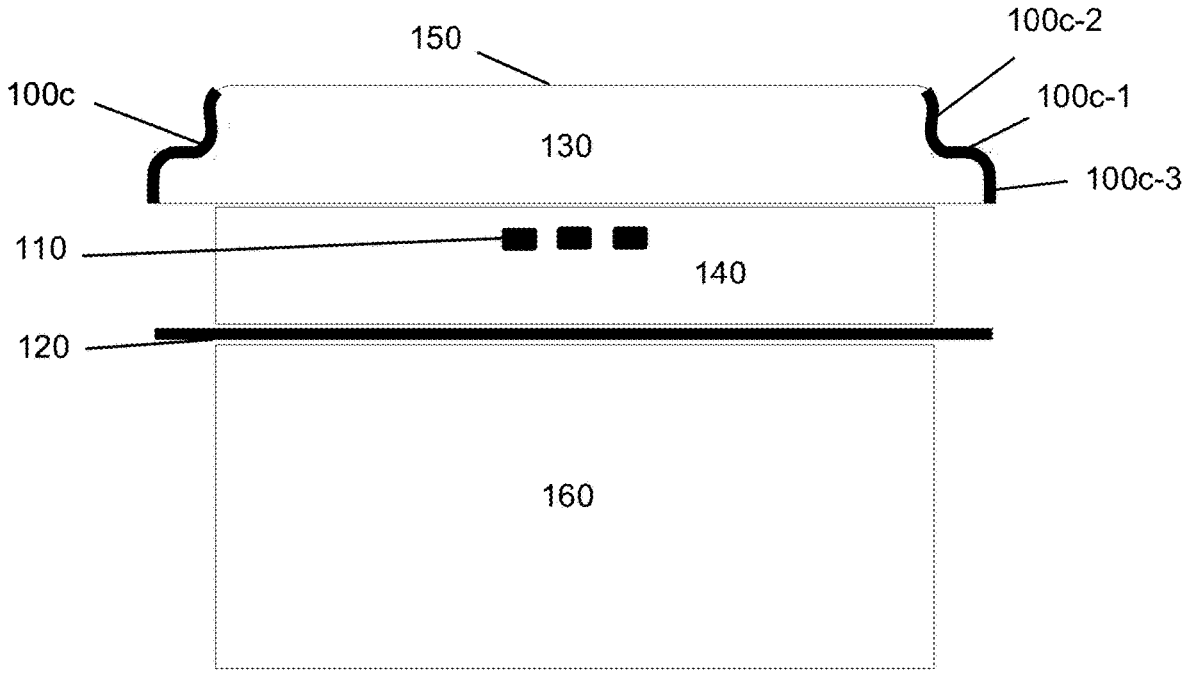

FIG. 1C depicts another embodiment of the antenna structure, wherein the first conducting element 100*c* may further comprise three surfaces, wherein each surface may wrap around the top region 130 in order to form a semi-circular shape. Furthermore, a first surface 100*c*-1 of the first conducting element 100*c* may lie on a plane that is parallel with the ground plane 120. A second surface 100*c*-2 of the first conducting element 100*c* may be adjacent to the first surface 100*c*-1 and extend, from the first surface 100*c*-1, towards a user-accessible surface 150. The second surface 100*c*-2 may further extend, from the first surface 100*c*-1, away from both the first surface 100*c*-1 and the ground plane 120. A third surface 100c-3 of the first conducting element 100c may be adjacent to the first surface 100c-1 and extend, from the first surface 100c-1, towards the ground plane 120. The third surface 100c-3 may further extend, from the first surface 100c-1, away from the first surface 100c-1 and the user-accessible surface 150.

Neither the second surface 100c-2 nor the third surface 100c-3 lie on a plane that is parallel with the ground plane 120. In some embodiments, a cross-section of the first conducting element 100c may comprise a z-shaped cross-section or an s-shaped cross section. The first surface 100c-1, second surface 100c-2, and third surface 100c-3 may each conform in shape with a semi-circular region of the top region 130.

In some embodiments, an orthogonal projection of the first conducting element 100c onto a plane that is parallel with the ground plane 120 may correspond to a projected area comprising some or all of the area of the first surface 100c-1 and some or none of the area of the second and third surfaces 100c-2 and 100c-3. The projected area may be less than the physical aperture of the first conducting element 100c. An orthogonal projection of the first surface 100c-1 onto a plane that is parallel with the ground plane 120 may produce a projected shape with an area comprising most or all of the area of the first surface 100c-1. An orthogonal projection of either the second or third surfaces 100c-2 and 100c-3 onto a plane that is parallel with the ground plane 120 may produce a projected shape with an area comprising none or some of the area of the second or third surfaces.

Furthermore, an orthogonal projection of the first conducting element 100c onto a plane that is parallel with the user-accessible surface 150 may correspond to a projected area comprising some or all of the area of the first surface 100c-1 and some or none of the area of the second and third surfaces 100c-2 and 100c-3. An orthogonal projection of the first surface 100c-1 onto a plane that is parallel with the user-accessible surface 150 may produce a projected shape with an area comprising most or all of the area of the first surface 100c-1. An orthogonal projection of either the second or third surfaces 100c-2 and 100c-3 onto a plane that is parallel with the user-accessible surface 150 may produce a projected shape with an area comprising none or only a partial area of the second or third surfaces.

The second conducting element 110 may operate as an undriven secondary antenna at the resonance frequency of the first conducting element 100c. In some embodiments, the second conducting element 110 may be located within component region 140 and may be further situated between the first conducting element 100c and the ground plane 120.

In some embodiments, an orthogonal projection of the second conducting element 110 onto a plane that is parallel with the ground plane 120 may overlap with an orthogonal projection of the first conducting element 100c onto the plane. Alternatively, an orthogonal projection of the second conducting element 110 onto a plane that is parallel with the ground plane 120 may not overlap with an orthogonal projection of the first conducting element 100c onto the plane.

According to further aspects, a diameter of the semi-circular region of the first conducting element may be between 5 mm and 15 mm. In some aspects, the first conducting element may further conform to a spiral shape. For example, the diameter of the semi-circular region may vary with azimuth along the length of the first conducting element. Furthermore, a distance between a location of the first conducting element and the ground plane may be different than another distance between another location of the first conducting element and the ground plane.

Figure 2:
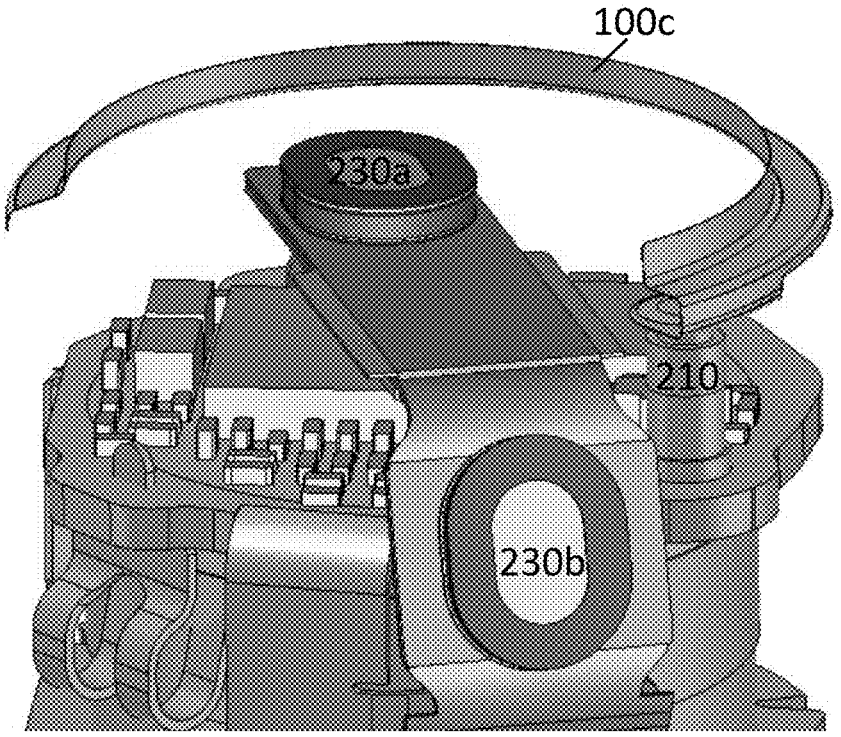
FIG. 2 is a diagram illustrating an arrangement of the antenna structure in relation to other elements that may be present in an earphone, in accordance with aspects described herein.

FIG. 2 depicts a three-dimensional perspective of the first conducting element 100c. In some embodiments, the first conducting element 100c may conform in shape with a semi-circular region, wherein the diameter of the semi-circular region is suitable for emplacement of the first conducting element 100c within an earphone device. Furthermore, the first conducting element 100c may be electrically connected, via one of its ends, to a feedline via a pogo pin 210 and an impedance matching network.

Parasitic elements may comprise flexible PCB and SMD components. Acoustic sealing elements 230a and 230b may be situated near the first conducting element 100c. For the purposes of this disclosure, "near" refers to the near-field of the antenna. Acoustic sealing elements 230a and 230b may each comprise closed cell urethane foam, pressure sensitive adhesive, and a layer of hydrophobic cloth to reduce the likelihood of moisture ingress. The acoustic sealing elements 230a and 230b may each cover, and thus may be located adjacent to, a MEMS microphone (depicted in FIG. 7).

The characteristics of the first conducting element 100c may be chosen such that the placement of the MEMS microphones within the antenna near-field has minimal effect on loading and detuning the first conducting element 100c. In other aspects, the acoustic sealing elements and MEMS microphones may be located within the component region 140 or may alternatively be located within the top region 130. In yet other aspects, the acoustic sealing elements and MEMS microphones may be partially located within the top region 130 and partially located within the component region 140. The MEMS microphones may be situated near the first conducting element 100c.

Figure 3:
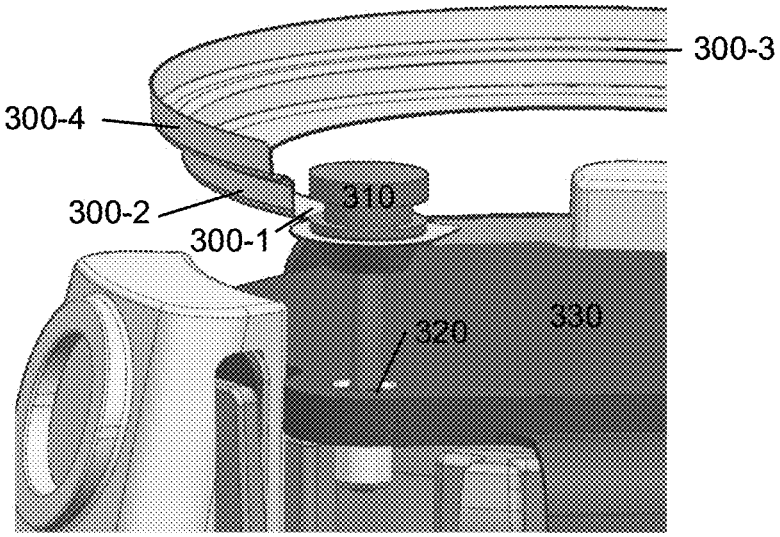
FIG. 3 depicts a view of an earphone, in accordance with aspects described herein.

FIG. 3 depicts another embodiment of the antenna structure, wherein the first conducting element comprises four surfaces, wherein each surface may conform to a semi-circular shape. Furthermore, a first surface 300-1 may lie on a plane that is parallel with the ground plane 320. The first surface 300-1 may further be connected to a feedline via pin 310 that is affixed by suitable methods (e.g., insert-molding, soldering, press-fit methods) to the top region 130. Moreover, the pin 310 may be electrically connected to a feedline via socket 320. The socket 320 may comprise one or more electrical connectors capable of electrically connecting the pin 310 to the feedline. A second surface 300-2 may be adjacent to the first surface 300-1 and may be oriented non-parallel with the ground plane 330. A third surface 300-3 may be adjacent to the second surface 300-2 and may be oriented parallel with the ground plane 330. A fourth surface 300-4 may be adjacent to the third surface 300-3 and may be oriented non-parallel with the ground plane 330.

In some embodiments, a cross-section of the antenna, which comprises the four surfaces, comprises one or more curves connected at either right angles or obtuse angles. The four surfaces 300-1, 300-2, 300-3, and 300-4 may each conform in shape with a semi-circular region.

In some embodiments, an orthogonal projection of the antenna structure onto a plane that is parallel with the ground plane 320 may correspond to a projected area comprising none, some, or all of the combined surface area of the surfaces 300-1, 300-2, 300-3, and 300-4.

Figure 4:
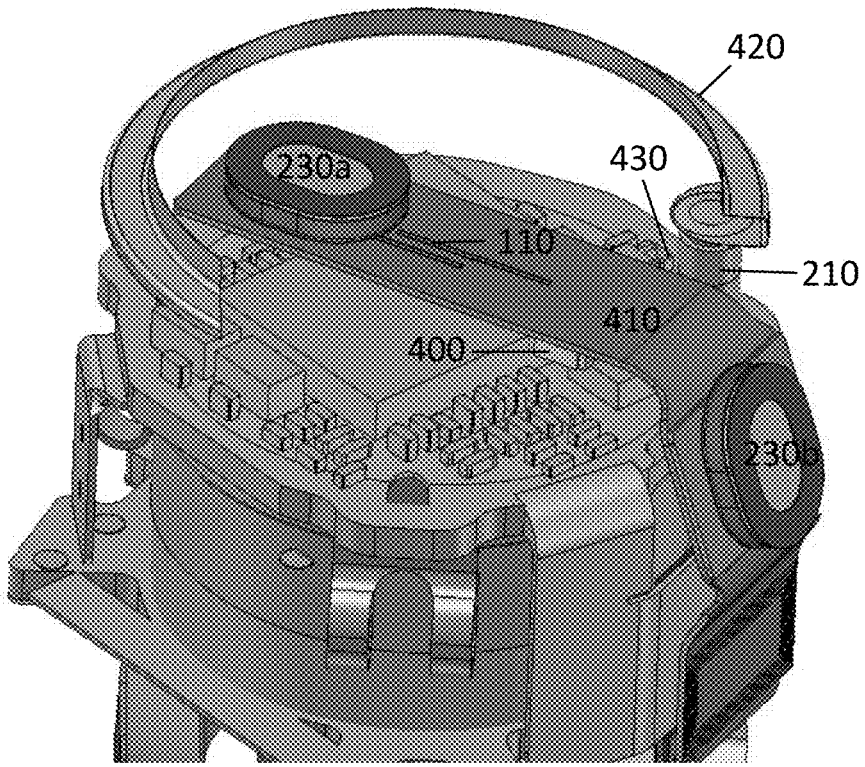
FIG. 4 depicts another embodiment of the antenna structure described herein.

FIG. 4 illustrates the placement of a decoupling network 400 according to some aspects of this disclosure. First conducting element 420 may correspond to first conducting elements 100a, 100b, 100c, or the antenna structure depicted in FIG. 3. Alternatively, first conducting element 420 may correspond to an antenna structure in accordance with this disclosure but not depicted in FIGS. 1A, 1B, 1C, and 3. Conductive component 410 may comprise one or more of a flexible printed-circuit-board (PCB), a rigid PCB, a flat ribbon wire, a conductive laser-direct-structuring structure, or an electrically conductive component constructed with 3D printing technology. Furthermore, conductive component 410 may comprise conducting traces 110 that may function as a secondary ground to the first conducting element 420. Thus, the placement of the decoupling network 400 in order to choke off the traces may avoid performance degradation due to parasitic coupling between the traces and first conducting element. This may be accomplished by choking off the traces at the resonance frequency of the first conducting element 420. For example, the decoupling network 400 may comprise an inductor with an inductance chosen to maximize the impedance of the decoupling network 400 at the resonance frequency of the first conducting element 420. In other embodiments, the decoupling network 400 may comprise a Ferrite bead chosen such that the impedance of the decoupling network 400 is maximized at the resonance frequency of the first conducting element 420.

In still other embodiments, the traces may not be choked off by the decoupling network 400. The decoupling network may comprise an inductor with an inductance selected so that the traces function as an undriven secondary antenna at the resonance frequency of the first conducting element 420. An impedance of the decoupling network 400 may be chosen such that a resonance frequency associated with the parasitic elements (i.e., traces, PCB components, MEMS microphone) corresponds to a resonance frequency of the antenna (i.e., first conducting element 420). In this manner, performance degradation of the first conducting element 420 due to the virtual image of the ground may be minimized.

Further depicted in FIG. 4 is an impedance matching network 430 in connection with the pogo pin 210. In some embodiments, the impedance matching network 430 may comprise one of a capacitor or an inductor. Alternatively, the impedance matching network 430 may comprise a capacitor and an inductor.

Figure 5:
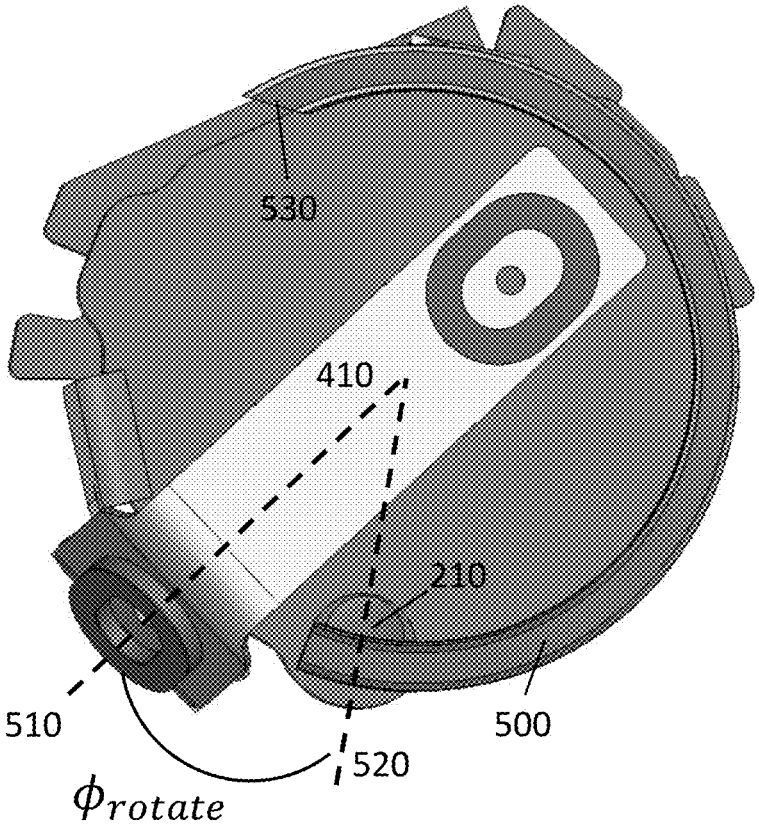
FIG. 5 depicts an arrangement of an antenna structure relative to other components of an earphone.

FIG. 5 depicts an arrangement of a first conducting element 500 with respect to conductive component 410. First conducting element 500 may correspond to first conducting elements 100*a*, 100*b*, 100*c*, or the antenna structure depicted in FIG. 3. Alternatively, first conducting element 500 may correspond to an antenna structure in accordance with this disclosure but not depicted in FIGS. 1A, 1B, 1C, and 3. A rotation angle $\phi_{rotate}$, depicted in FIG. 5 with respect to the imaginary lines 510 and 520, may correspond to an angle between 20 degrees to 60 degrees. In general, antenna performance is reduced due to proximity of the conductive component 410 with either the antenna end point 530 or the pogo pin 210. However, the rotation angle may be selected in order to minimize this performance degradation.

Figure 6:
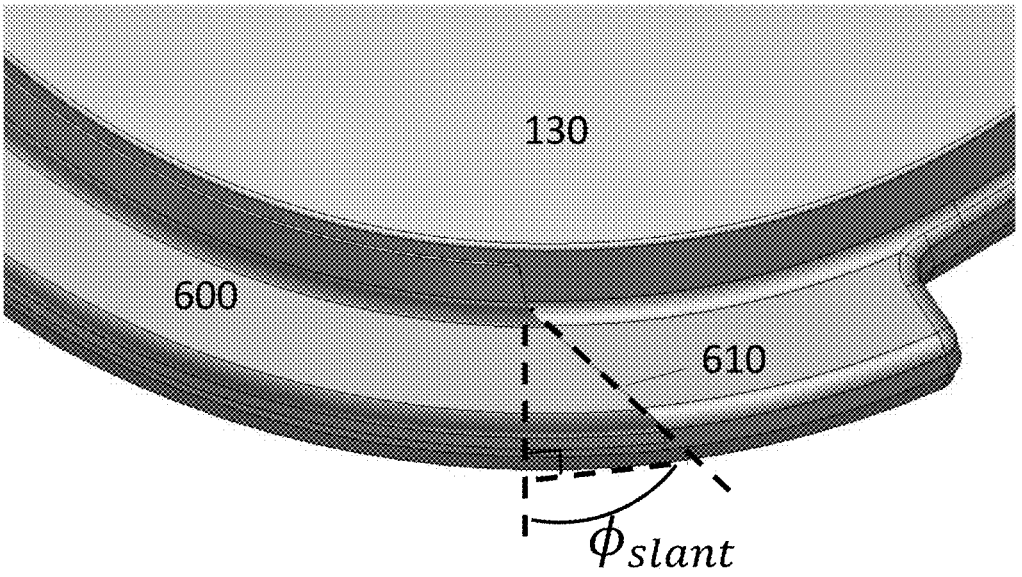
FIG. 6 depicts a view of a portion of the antenna structure, according to some embodiments.

FIG. 6 illustrates a tapered end of the first conducting element 600. First conducting element 600 may correspond to first conducting elements 100*a*, 100*b*, 100*c*, or the antenna structure depicted in FIG. 3. Alternatively, first conducting element 600 may correspond to an antenna structure in accordance with this disclosure but not depicted in FIGS. 1A, 1B, 1C, and 3. In some embodiments, this tapered end may comprise a tapered end corresponding to right triangle 610. The right triangle 610 may be associated with a slanted angle $\phi_{slant}$, wherein $\phi_{slant}$ may correspond to a value between 0 degrees to 60 degrees. The tapering of an end of the first conducting element 600 may serve a dual purpose of moving a critical antenna section away from the ground plane 120, thus minimizing the detrimental effects of radiation from the virtual image, while further increasing the antenna operating bandwidth.

Figure 7:
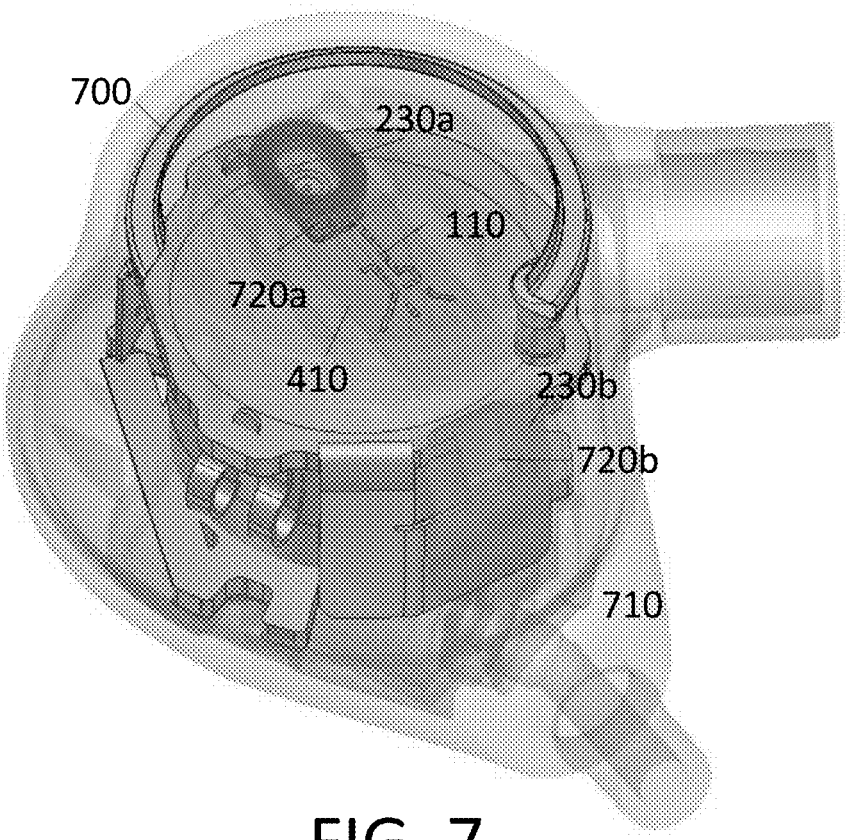
FIG. 7 depicts the location of additional elements in relation to the location of the antenna structure, in accordance with aspects described herein.

FIG. 7 is an illustration showing an example internal arrangement of a wireless earphone comprising first conducting element 700 and second conducting element 110 within an encasing 710, in accordance with aspects described herein. First conducting element 700 may correspond to first conducting elements 100*a*, 100*b*, 100*c*, or the antenna structure depicted in FIG. 3. Alternatively, first conducting element 700 may correspond to an antenna structure in accordance with this disclosure but not depicted in FIGS. 1A, 1B, 1C, and 3. As depicted in FIG. 7, the shape of the encasing 710 may be designed to conform to protect the components inside the encasing while keeping the size of the encasing to a minimum, so that the overall earphone is small enough to be worn by a wearer. The first conducting element 700 may be positioned so that it is relatively far from the ear of a wearer, when worn. Acoustic sealing elements 230*a* and 230*b* may be affixed between conductive component 410 and the inner wall of the encasing 710.

Microphones, such as MEMS microphone 720*a* and 720*b* may be positioned to capture audio. In some embodiments, MEMS microphones 720*a* and 720*b* may capture the voice of the wearer, for example, when the wearer is speaking during a phone call or when the wearer is providing voice commands to interact with an audio source, such as a music player. The MEMS microphones 720*a* and 720*b* may be used in beam forming to better capture the wearer's voice. In addition, the MEMS microphones 720*a* and 720*b* may capture external noise, such as wind noise or interfering speech, and the signal from the MEMS microphones 720*a* and 720*b* may be used in noise suppression processing. In some embodiments, MEMS microphones 720*a* and 720*b* are affixed to conductive component 410.

Figure 8:
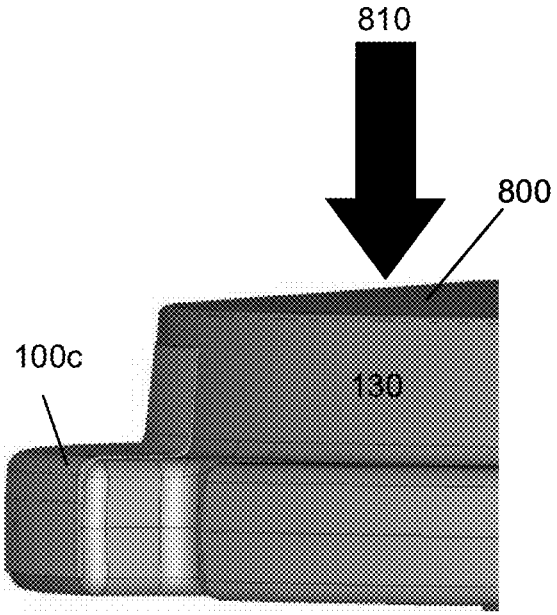
FIG. 8 illustrates a portion of the earphone that is accessible to user interactions, according to at least one embodiment.

FIG. 8 illustrates a user-accessible surface 800 of the top region 130. The user-accessible surface 800 corresponds to a portion of the earphone that is exposed to the outside world, and thus, is accessible to user interactions, such as touching. The direction from which the touching of the user-accessible surface 800 may typically occur is illustrated by arrow 810. The proximity of a human body to a wearable antenna may cause antenna performance issues such as detuning and absorption, however the first conducting element 100*c* may minimize coupling with the user during these interactions. For example, the second and third surfaces 100*c*-2 and 100*c*-3 of the first conducting element 100*c* may correspond to geometric planes that are non-parallel with the user-accessible surface 800. Thus, the first conducting element 100*c* may be more resilient to coupling with portions of a human body, such as a finger, that may interact with the user-accessible surface 800.

Although examples are described above, features and/or steps of those examples may be combined, divided, omitted, rearranged, revised, and/or augmented in any desired manner. Various alterations, modifications, and improvements will readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

What is claimed is:

1. A wireless earphone, comprising:

a main body comprising an encasing, a battery, and a ground plane;

an antenna comprising a plurality of surfaces conforming in shape with a semi-circular region of the encasing, wherein one or more surfaces of the plurality of surfaces is non-parallel with the ground plane, and wherein a surface of the plurality of surfaces is adjacent to and non-parallel with one or more other surfaces of the plurality of surfaces;

a conducting structure situated between the ground plane and the antenna, wherein the conducting structure is electrically connected to the ground plane; and one or more conducting components affixed to the conducting structure.

2. The wireless earphone of claim 1, wherein the antenna further comprises a tapered end comprising a tapering corresponding to a slanted angle, and wherein the tapered end is configured to increase an operating bandwidth of the antenna.

3. The wireless earphone of claim 1, wherein the conducting structure is electrically connected to the ground plane via an impedance network comprising one of:

an inductor or a ferrite bead with a maximum impedance at a resonance frequency of the antenna; or an inductor with a self-resonance frequency corresponding to a resonance frequency of the antenna.

4. The wireless earphone of claim 1, wherein the one or more conducting components comprise one or more of a micro-electromechanical-system (MEMS) microphone, surface-mount-device (SMD) components, or traces.

5. The wireless earphone of claim 1, wherein a cross-section of the antenna comprises one or more curves, wherein each of the one or more curves are connected with each other at right angles or obtuse angles.

6. The wireless earphone of claim 1, further comprising a feedline, wherein an end of the antenna is connected to the feedline via an impedance matching network and one of (1) a pogo pin or (2) a pin and a socket.

7. The wireless earphone of claim 1, wherein the conducting structure comprises one or more of a flexible printed-circuit-board (PCB), a rigid PCB, a flat ribbon wire, a conductive laser-direct-structuring structure, or an electrically conductive component constructed with 3D printing technology.

8. An antenna structure, comprising:

a ground plane;

a first conducting element comprising a plurality of surfaces conforming in shape with a semi-circular region, wherein one or more surfaces of the plurality of surfaces is non-parallel with the ground plane, and wherein a surface of the plurality of surfaces is adjacent to and non-parallel with one or more other surfaces of the plurality of surfaces; and a second conducting element, situated between the ground plane and at least one of the one or more surfaces of the first conducting element.

9. The antenna structure of claim 8, the second conducting element comprises traces electrically connected to the ground plane via an impedance network comprising:

an inductor or a ferrite bead with a maximum impedance at a resonance frequency of the first conducting element; or an inductor with a self-resonance frequency corresponding to a resonance frequency of the first conducting element.

10. The antenna structure of claim 8, wherein a cross-section of the first conducting element comprises one or more curves, wherein each of the one or more curves are connected with each other at right angles or obtuse angles.

11. The antenna structure of claim 8, further comprising:

a conducting structure situated between the ground plane and the first conducting element, wherein the conducting structure is electrically connected to the ground plane; and one or more conducting components affixed to the conducting structure.

12. The antenna structure of claim 11, wherein the one or more conducting components comprises one or more of a MEMS microphone, SMD components, or traces.

13. The antenna structure of claim 11, wherein the conducting structure comprises one or more of a flexible PCB, a rigid PCB, a flat ribbon wire, a conductive laser-direct-structuring structure, or an electrically conductive component constructed with 3D printing technology.

14. The antenna structure of claim 8, wherein the first conducting element is connected to a feedline via an impedance matching network and one of (1) a pogo pin or (2) a pin and a socket.

15. The antenna structure of claim 8, wherein the first conducting element is electrically connected, via an impedance matching network comprising at least one of an inductor or a capacitor, to a feedline.

16. A wearable device, comprising:

a main body comprising an encasing with a top surface accessible to user interactions, a battery, and a ground plane;

an antenna comprising a plurality of surfaces conforming in shape with a semi-circular region of the encasing, wherein an orthogonal projection of one or more surfaces of the plurality of surfaces onto a plane that is parallel with the top surface accessible to user interactions consists of an area that is less than a physical aperture of the one or more surfaces of the plurality of surfaces, and wherein a surface of the plurality of surfaces is adjacent to and non-parallel with one or more other surfaces of the plurality of surfaces;

a conducting structure situated between the ground plane and the antenna; and one or more conducting components affixed to the conducting structure.

17. The wearable device of claim 16, wherein the conducting structure is electrically connected to the ground plane via an impedance network comprising one of:

an inductor or a ferrite bead with a maximum impedance at a resonance frequency of the antenna; or an inductor with a self-resonance frequency corresponding to a resonance frequency of the antenna.

18. The wearable device of claim 16, wherein the conducting structure comprises one or more of a flexible PCB, a rigid PCB, a flat ribbon wire, a conductive laser-direct-structuring structure, or an electrically conductive component constructed with 3D printing technology.

19. The wearable device of claim 16, wherein the one or more conducting components comprises one or more of a MEMS microphone, SMD components, or traces.

20. The wearable device of claim 16, wherein the antenna further comprises a tapered end configured to increase an operating frequency bandwidth of the antenna.

* * * * *